United States Patent [19]

Baum et al.

[11] 4,375,344

[45] Mar. 1, 1983

[54] BUCKET LEVELING MECHANISM

[75] Inventors: Dean O. Baum; James E. Dawson, both of Burlington, Iowa

[73] Assignee: J. I. Case Company, Racine, Wis.

[21] Appl. No.: 280,157

[22] Filed: Jul. 2, 1981

[51] Int. Cl.[3] ..... E02F 3/00

[52] U.S. Cl. ..... 414/708; 414/709; 414/700

[58] Field of Search ..... 414/706, 708, 709, 714, 414/701, 700

[56] References Cited

U.S. PATENT DOCUMENTS

| | | | |
|---|---|---|---|
| 3,032,215 | 5/1962 | French et al. | 414/708 X |
| 3,410,433 | 11/1968 | Brown | 414/708 X |
| 3,695,474 | 10/1972 | Blakely | 414/708 |

FOREIGN PATENT DOCUMENTS

| | | | |
|---|---|---|---|
| 1191207 | 5/1970 | United Kingdom | 414/708 |

*Primary Examiner*—Robert J. Spar
*Assistant Examiner*—Terrance L. Siemens
*Attorney, Agent, or Firm*—Cullen, Sloman, Cantor, Grauer, Scott & Rutherford

[57] ABSTRACT

A bucket leveling mechanism that automatically operates a tilt cylinder for pivoting the bucket so that the attitude of the bucket remains substantially constant as the bucket lift arms are raised. Two push-pull cable assemblies are provided; one cable assembly senses the rotation of the bucket and the other cable assembly senses the pivotal movement of the lift arms. The cable assembly for the bucket is attached between the bucket and a wedge shaped block that operates a spool control valve for the bucket tilt cylinder. The lift arm cable assembly is attached to a lift arm at one end and includes an opposite roller end that engages one side of the wedge shaped block, with the block being sandwiched between the control valve spool and roller end of the lift arm cable assembly. The wedge shaped block includes a cam surface that is movable between the control valve spool and roller end of the lift arm cable assembly in proportion to the relative movement of the bucket and lift arms. When the lift arms are raised to a predetermined height where the bucket would normally roll back past a level position, the roller end of the lift arm cable assembly acts upon the wedge shaped block to push the cam surface against the control valve spool to thereby automatically actuate the bucket tilt cylinder for rotating the bucket toward a level position. The wedge shaped block also provides a positive stop that prevents the operator from manually overriding the level position of the bucket when the lift arms are fully raised.

6 Claims, 2 Drawing Figures

BUCKET LEVELING MECHANISM

BACKGROUND OF THE INVENTION

This invention relates to a front end loader of the type having a material handling bucket supported for pivotal movement about a transverse axis by the forward end of a boom structure. In machines of this type, usually some form of hydraulic means is provided for tilting the bucket about its pivotal connection with the boom structure to cause the bucket to be located with its cutting edge in engagement with the ground when in a dig position and rolled back for maintaining the material within the bucket when being transported to a dumping location. Thus, the present invention is directed to a control mechanism for automatically positioning the material handling bucket relative to the supporting boom structure during raising and lowering of the boom structure.

The conventional front end loader disclosed herein includes an elongated body having an engine compartment adjacent the rear end thereof and an operator's compartment mounted on the body. A pair of stanchions or uprights are fixedly secured to the body adjacent the opposite sides of the engine compartment and extend upwardly therefrom. A pair of lift arms are pivotally connected at one end about a common pivot axis on the respective uprights and extend generally forwardly along opposite sides of the body in close proximity to the operator's compartment and terminate in downwardly directed end portions. A material handling device, such as a bucket, is pivotally supported on the free ends thereof and is normally pivoted between "roll-back" and "dump" positions by hydraulically operated linkage mechanism that is controlled by the operator seated in the operator's compartment.

The pivotal movement of the bucket is accomplished through a pair of fluid rams, each one having one end pivotally connected to the bucket at a location spaced from the pivotal connection of the bucket to the free ends of the lift arms and an opposite end connected to a lift arm at a location laterally offset from the longitudinal axis of the downwardly directed end portion of the lift arm.

In the raising and lowering of the lift arms and the bucket relative to the uprights, normally through a second pair of fluid rams located between the uprights and the lift arms or boom structure, the tilt of the bucket tends to increase and, if uncorrected, might dump material over the top edge of the bucket and down onto the tractor. To correct this tendency, it is customary to incorporate a self-leveling linkage system that cooperates with the tilt fluid ram for pivoting the bucket so that the attitude of the bucket remains substantially constant as the lift arms are raised after the bucket has been filled with material.

While the compensating systems of the prior art have contributed significantly to overcoming the problem of dumping material or contents from the material handling device onto the tractor, the arrangements disclosed have been relatively complex and expensive to fabricate. Thus, it is an object of the present invention to provide an improved bucket leveling mechanism that is easy to manufacture and reliable in operation in various environments.

SUMMARY OF THE INVENTION

In accordance with the present invention, the improved bucket leveling mechanism automatically operates the tilt cylinder for pivoting the bucket so that the attitude of the bucket remains substantially constant as the lift arms are raised.

The present invention is disclosed in connection with a machine having an elongated body portion with an engine compartment adjacent the rear end thereof and an operator's compartment mounted to the body portion with uprights extending above the body on opposite sides of the engine compartment. A pair of lift arms are pivotally connected at one end to the uprights at a location spaced above the main body and they have a main portion extending past the operator's compartment with angularly related or downwardly directed end portions adjacent the front end thereof. The lift arms are adapted to be raised and lowered along opposite sides of the operator's compartment by a pair of fluid rams having opposite ends connected to the respective uprights and lift arms. A material handling device, such as a bucket, is pivoted on the free ends of the downwardly directed end portions of the lift arms and is moved through a hydraulic linkage system for each of the lift arms.

According to the invention, two push-pull cable assemblies are provided; one of the cable assemblies senses the rotation of the bucket and the other cable assembly senses the pivotal movement of the lift arms. The cable assembly for the bucket is attached at one end to the bucket or a member causing rotation of the bucket and its other end is attached to a movable, wedge shaped block that is operably connected to a spool control valve for the bucket tilt cylinder. One end of the lift arm cable assembly is attached to a lift arm or member causing rotation of the lift arm and its other end includes a roller which acts upon the side of the movable wedge shaped block in a direction perpendicular to the longitudinal axis of the wedge shaped block.

The wedge shaped block includes opposed sides with one of the sides having a cam surface that engages the spool for the bucket tilt cylinder control valve and an opposite side that is acted upon by the roller end of the lift arm cable assembly. The bucket cable assembly is attached at one end of the wedge shaped block for moving the block longitudinally within the space between the control valve spool and roller end of the lift arm cable assembly. Thus, the wedge shaped block is sandwiched between the tilt control valve spool and roller end of the lift arm cable assembly and is linearly movable in response to movement by the bucket cable assembly.

The cam surface on the wedge shaped block includes a ramp portion that is inclined relative to the longitudinal axis of the wedge shaped block at an angle that is a ratio of lift arm movement to bucket movement. In a dig position, the bucket is first located with its cutting edge in engagement with the ground and then rolled back for maintaining the material within the bucket. As the bucket is rolled back, the bucket cable assembly pushes on the end of the wedge shaped block to align the thicker part of the block ramp portion between the control valve spool and roller end of the lift arm cable assembly. The lift arm cable assembly does not push against the side of the block when the lift arms are lowered to permit digging by the bucket and therefore, does not interfere with the normal roll back and dump movements of the bucket.

When the lift arms are raised to a predetermined height where the bucket would normally roll back past a level position, the roller end of the lift arm cable assembly then acts upon the side of the wedge shaped block to push the cam surface against the control valve spool to thereby automatically actuate the bucket tilt cylinder for rotating the bucket toward a level position. As the lift arms are being raised and the bucket is being rotated forwardly toward a level position in response to actuation of its tilt cylinder, the bucket cable assembly pulls on the wedge shaped block until the thinner part of the block ramp portion is located between the control valve spool and roller end of the lift arm cable assembly, at which point the bucket is held at a level position with the lift arms fully raised.

Thus, the movement of the block ramp portion within the space between the control valve spool and roller end of the lift arm cable assembly is proportional and timed with the relative movement of the bucket and lift arms. The wedge shaped block also provides a positive stop that prevents the operator from manually overriding the level position of the bucket when the lift arms are fully raised.

Other advantages and meritorious features of the bucket leveling mechanism of the present invention will be more fully understood from the following description of the invention, the appended claims, and the drawings, a brief description of which follows.

DETAILED DESCRIPTION OF THE INVENTION

Figure 1:
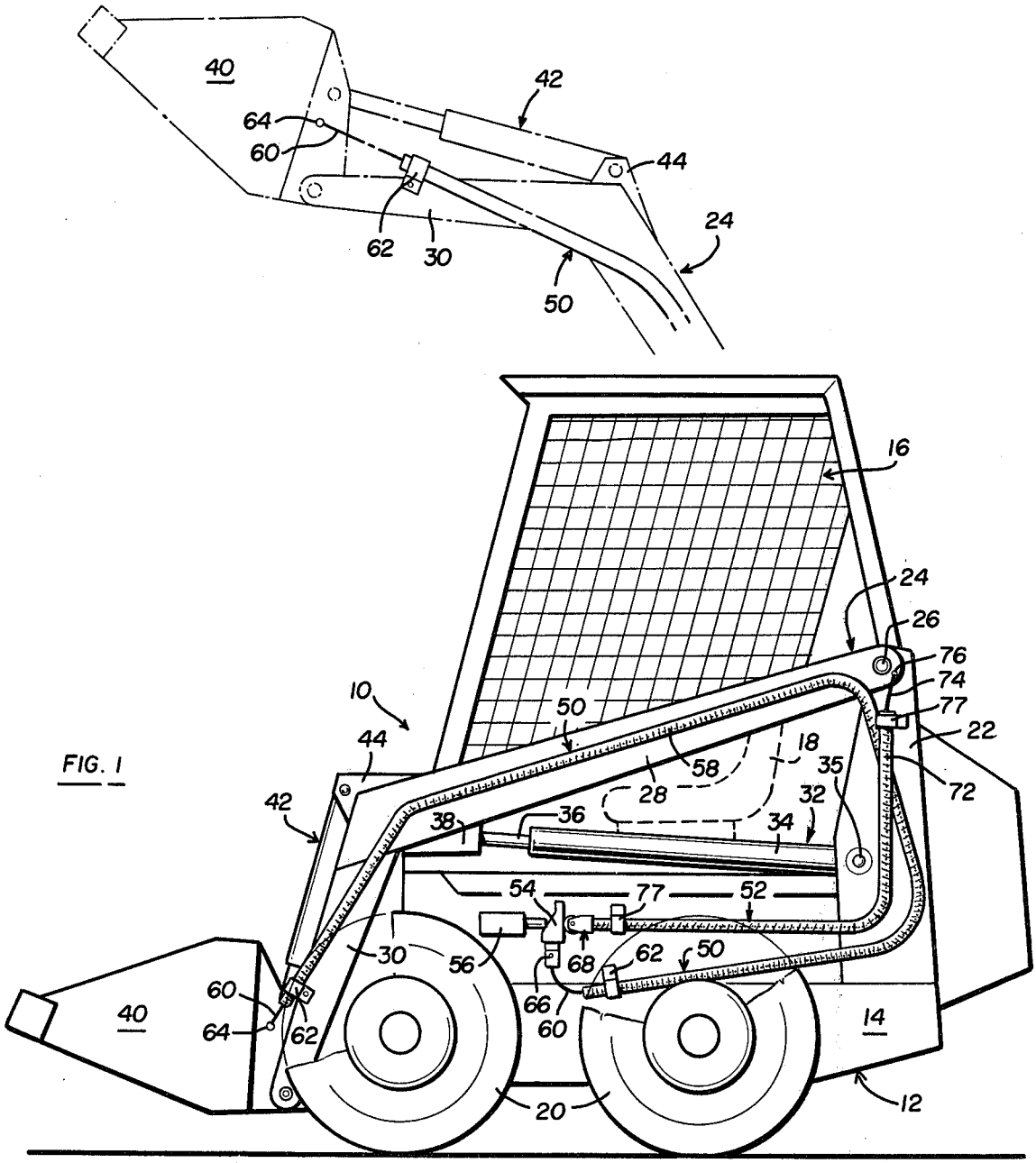
FIG. 1 is a side elevational view of the material handling unit having the present invention incorporated therein.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

FIG. 1 of the drawings generally discloses a front end loader 10 consisting of an elongated body 12 having an engine compartment 14 and an operator's compartment 16 with a seat 18 located in the operator's compartment between opposite sides of the elongated body 12. The body 12 is supported by ground engaging means consisting of four wheels 20, only two of which are shown in FIG. 1.

Since the remaining elements to be described, with the exception of the material handling device and the bucket leveling mechanism, are duplicated on opposite sides of the main body, only one set of elements has been shown with the understanding that the description will likewise refer to an identical set of elements located on the opposite side of the engine housing 14 and operator's compartment 16.

A pair of transversely spaced stanchions or uprights 22 extend upwardly along opposite sides of the engine compartment 14 and terminate above the body 12 at a location spaced above the operator's seat 18. A lift arm 24 is pivotally connected at one end by a pivot pin 26 to the upper end of each of the uprights 22 and the two pivot pins 26 for the lift arms 24 are located upon a common horizontal axis. The lift arms 24 each consist of an elongated generally straight main body portion 28 and an angularly related or downwardly directed end portion 30 that extends downwardly adjacent the forward end of the body 12. Each of the lift arms 24 is adapted to be raised and lowered on the loader 10 by a fluid ram 32 including a cylinder 34 pivoted on the upright 22 by pin 35 adjacent its lower end and a piston rod 36 connected to a pair of plates 38 that are mounted to the underside of lift arm body portion 28. Extension and retraction of fluid rams 32 will move the lift arms 24 between raised and lowered positions, respectively, shown in dotted and solid lines of FIG. 1.

The downwardly directed end portions 30 which extend generally vertically when the lift arms 24 are in their lowered position, are interconnected by a material handling implement 40, such as a bucket or lift fork. According to the present invention, the bucket 40 is pivoted on the lift arms 24 through a hydraulic linkage that includes a tilt fluid cylinder 42 connected between bucket 40 and mounting plates 44 on lift arm body portion 28.

Thus, assuming that the operator has just filled the bucket or material handling device 40 with dirt or the like and has pivoted the bucket to the "roll-back" position shown in FIG. 1, by completely retracting the fluid rams 42, subsequent extension of the fluid rams 32 will move the lift arms 24 from the solid line to the dotted line position shown in FIG. 1. During such movement, the bucket 40 would automatically be tilted rearwardly as the lift arms were raised, were it not for the bucket leveling mechanism to be described.

In accordance with the present invention, the improved bucket leveling mechanism automatically operates the tilt cylinders 42 for pivoting the bucket 40 so that the attitude of the bucket 40 remains substantially constant as the lift arms 24 are raised.

According to the invention, two push-pull cable assemblies are provided, one of the cable assemblies 50 senses the rotation of the bucket 40 and the other cable assembly 52 senses the pivotal movement of the lift arms 24. The cable assembly 50 for the bucket is attached at one end to the bucket 40 or a member causing rotation of the bucket and its other end is attached to a movable, wedge shaped block 54 that is operably connected to a spool control valve 56 for the bucket tilt cylinder 42. Cable assembly 50 includes an outer casing 58 and a movable rod member 60 housed therein, with the opposite ends of casing 58 being attached by brackets 62 to lift arm portion 30 and body frame 12 for thereby permitting slidable movement of rod member 60 within casing 58. As illustrated, one end of rod member 60 is attached to bucket 40 at point 64 while the opposite end of rod member 60 is attached to wedge shaped block 54 by pin 66.

The lift arm cable assembly 52 is attached at one end to a lift arm 24 or a member causing rotation of the lift arm and its other end includes a roller assembly 68 which acts upon the side 70 of the movable wedge shaped block 54 in a direction perpendicular to the longitudinal axis of block 54. Cable assembly 52 includes an outer casing 72 and a movable rod member 74 housed therein, with the opposite ends of casing 72 being attached by brackets 77 to upright 22 and body frame 12 for thereby permitting slidable movement of rod member 74 within casing 72. One end 76 of rod member 74 is attached below and to one side of lift arm pivot point 26 to prevent actuation of rod member 74 when the lift arms 24 are lowered. The other end of rod member 74 is attached to roller assembly 68 to act upon wedge shaped block 54 when lift arms 24 are raised to a predetermined height where bucket 40 would normally roll back past a level position.

Figure 2:
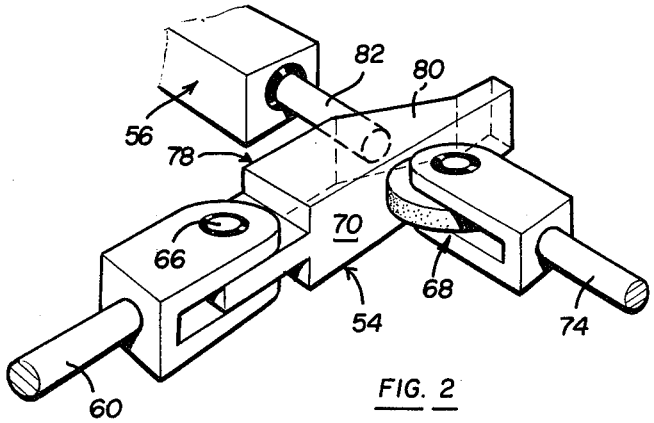
FIG. 2 is a fragmentary perspective view illustrating the components for actuating the bucket tilt cylinder to provide bucket leveling.

The wedge shaped block 54 includes opposed sides 70 and 78 with side 78 having a cam surface that engages the spool 82 for bucket tilt cylinder control valve 56 and an opposite side 70 that is acted upon by the roller end 68 of lift arm cable assembly 52. The bucket cable assembly 50 is attached by pin 66 to one end of wedge shaped block 54 for moving block 54 longitudinally within the space between the control valve spool 82 and roller end 68 of cable assembly 52, as illustrated in FIG. 2. Thus, block 54 is sandwiched between the tilt control valve spool 82 and roller end 68 of cable assembly 52 and is linearly movable in response to movement by the bucket cable assembly 50.

The cam surface 78 on the wedge shaped block 54 includes a ramp portion 80 that is inclined relative to the longitudinal axis of the wedge shaped block 54 at an angle that is a ratio of lift arm movement to bucket movement. In a dig position, bucket 40 is first located with its cutting edge in engagement with the ground and then rolled back for maintaining the material within the bucket as illustrated in FIG. 1. As bucket 40 rolls back, rod member 60 pushes on the end of wedge shaped block 54 to align the thicker part of block ramp portion 80 between the control valve spool 82 and roller end 68 of lift arm cable assembly 52. Lift arm cable assembly 52 does not push against the side of block 54 when lift arms 24 are lowered to permit digging by the bucket 40 and therefore, does not interfere with the normal roll back and dump movements of bucket 40.

When lift arms 24 are raised to a predetermined height where bucket 40 would normally roll back past a level position, the roller end 68 of cable assembly 52 then acts upon the side 70 of wedge shaped block 54 to push the ramp surface 80 against control valve spool 82 thereby automatically actuating the bucket tilt cylinder 42 for rotating bucket 40 toward a level position. As lift arms 24 are being raised and bucket 40 is being rotated forwardly toward a level position in response to actuation of tilt cylinder 42, rod member 60 pulls on wedge shaped block 54 until the thinner part of block ramp portion 80 is located between control valve spool 82 and roller end 68, at which point the bucket 40 is held at a level position with the lift arms 24 fully raised.

Thus, the movement of block ramp portion 80 within the space between control valve spool 82 and roller end 68 is proportional and timed with the relative movement of bucket 40 and lift arms 24. The wedge shaped block 54 also provides a positive stop that prevents the operator from manually overriding the level position of bucket 40 when lift arms 24 are fully raised.

It will be apparent to those skilled in the art that the foregoing disclosure is exemplary in nature rather than limiting, the invention being limited only by the appended claims.

We claim:

1. In a front end loader having an elongated body, a pair of lift arms pivotally connected at one end to said body, a bucket pivotally connected to the other end of said lift arms, a fluid tilt cylinder connected to said bucket for tilting said bucket about its pivotal connection with said lift arms, and a pair of fluid lift cylinders for moving said lift arms between lowered and raised positions, the improvement comprising:

a bucket leveling mechanism that automatically operates said bucket tilt cylinder for pivoting said bucket so that the attitude of said bucket remains substantially constant as said lift arms are raised, said bucket leveling mechanism including a push-pull bucket cable assembly for sensing the rotation of said bucket and a push-pull lift arm cable assembly for sensing the pivotal movement of said lift arms, said bucket cable assembly being attached at one end to said bucket and at its other end to a movable block member that is operably connected to a control valve associated with said bucket tilt cylinder, one end of said lift arm cable assembly being attached to a lift arm and the other end of said lift arm cable assembly acting upon said block member in a direction perpendicular to the longitudinal axis of said block member, said block member including opposed sides with a first of the sides having a cam surface that engages a spool extending from said control valve and a second, opposite side that is acted upon by said other end of said lift arm cable assembly, said bucket cable assembly being attached to one end of said block member for moving said block member longitudinally within a space between said control valve spool and the other end of said lift arm cable assembly in response to rotation of said bucket, said lift arm cable assembly acting upon said second side of said block member when said lift arms are raised to a predetermined height where said bucket would normally roll back past a level position to push said block member cam surface against said control valve spool and thereby automatically actuate said bucket tilt cylinder for rotating said bucket to a level position.

2. The front end loader as defined in claim 1 wherein said bucket cable assembly includes a casing having a first movable rod member housed therein for slidable movement relative to said casing, one end of said first rod member being attached to said bucket and the other end of said first rod member being attached to said one end of said block member.

3. The front end loader as defined in claim 2 wherein said lift arm cable assembly includes a housing having a second movable rod member housed therein for slidable movement relative to said housing, one end of said second rod member being attached to one of said lift arms and the other end of said second rod member being attached to a roller assembly, said roller assembly acting upon said second side of said block member when said lift arms are raised to said predetermined height.

4. The front end loader as defined in claim 3 wherein said one end of said second rod member being attached to said one lift arm at a location offset from the pivotal connection between said one lift arm and said elongated body such that said lift arm only acts upon said second rod member when said lift arms are raised to said predetermined height.

5. The front end loader as defined in claim 1 wherein said block member is wedge shaped and said cam surface includes a ramp portion that is inclined relative to the longitudinal axis of said block member.

6. The front end loader as defined in claim 5 wherein said block member is movable within the space between said control valve spool and the other end of said lift arm cable assembly in proportion to the relative movement of said bucket and lift arms and said block member providing a stop for preventing an operator from manually overriding said control valve when said lift arms are in their raised position.

* * * * *